US006619052B1

(12) United States Patent
Nash, Jr.

(10) Patent No.: US 6,619,052 B1
(45) Date of Patent: Sep. 16, 2003

(54) VARIABLE AIR CURTAIN VELOCITY CONTROL

(75) Inventor: Robert V. Nash, Jr., Niles, MI (US)

(73) Assignee: Tyler Refrigeration Corporation, Niles, MI (US)

( * ) Notice: Subject to any disclaimer, the term of this patent is extended or adjusted under 35 U.S.C. 154(b) by 0 days.

(21) Appl. No.: 10/086,097

(22) Filed: Feb. 26, 2002

(51) Int. Cl.[7] ..... F25D 17/04; A47F 3/04
(52) U.S. Cl. ..... 62/89; 62/186; 62/256
(58) Field of Search ..... 62/89, 186, 255, 62/256

(56) References Cited

U.S. PATENT DOCUMENTS 3,444,698 A * 5/1969 Lorenz ..... 62/128
3,771,323 A * 11/1973 Simons et al. ..... 62/89
6,112,546 A * 9/2000 Kim ..... 62/440

* cited by examiner

*Primary Examiner*—William E. Tapolcai
(74) *Attorney, Agent, or Firm*—Carlson, Gaskey & Olds

(57) ABSTRACT

A refrigeration system comprises a display case having an exterior and an interior. A fan blows or draws air across an evaporator coil to cool the display case. The air is blowing over a viewing area to create an air curtain. At least one sensor obtains environmental data, which is fed to a control unit. The control unit communicates with the fan and adjusts the air curtain based on the sensed environmental data.

21 Claims, 2 Drawing Sheets

VARIABLE AIR CURTAIN VELOCITY CONTROL

BACKGROUND OF THE INVENTION

This invention relates to a variable velocity air curtain for a refrigeration display case.

Supermarkets and retailers of other perishable goods use refrigerator display cases to both refrigerate and display such goods. Generally, these display cases are simple and unsophisticated refrigeration units that comprise a case and an open viewing area that permits consumers to reach into the refrigerated section of the case to retrieve the perishable item. A curtain of air is typically blown across the viewing area from the top of the case down to a warm air return at the bottom of the case. The air travels to an air inlet of the return that feeds the air back to a fan that draws the air not only into the inlet but across an evaporator coil that cools the air. The fan is fixed in speed, blowing a constant amount of air across the viewing area. This air curtain serves to create a wall of air that prevents warm air from outside of the case from entering the interior of the case.

Given the open nature of the display case, environmental conditions may affect the interior temperature of the refrigeration unit. Specifically, if the temperature of a location, such as a store, is high, the interior of the display case may also warm. Moreover, frequent intrusion into the display cases' interior by consumers reaching for and removing product may also affect the temperature within the interior. Current systems have few effective mechanisms for addressing changing exterior and interior environmental conditions about the refrigeration display case.

A need therefore exists for a display case that may account for these environmental conditions and cool the interior of the display case in a cost effective manner.

SUMMARY OF THE INVENTION

The invention comprises a refrigeration display case that employs an environmental sensor and a control unit that controls the fans to alter the rate of air flow across the viewing area of the display case. The refrigeration system comprises a display case, an evaporator coil, fans, a viewing area set across the display case, at least one sensor for obtaining environmental data, and a control unit. The control unit controls the speed of the fans based on the sensed environmental data.

By controlling the speed of the fans, the control unit alters the rate of air moved across the viewing area, providing more or less cold air depending on the sensed environmental conditions. The control unit may adjust the rate of air by altering the speed of the fan, altering the Hertz rating of the fan, or altering the angle of the fan blades of the fan.

Additionally, the control unit may control more than one fan separately. This allows the control unit to alter the rate of air moved by each of the fans together or differently. The control unit may receive environmental data from a wide variety of sensors. One sensor may provide data on air pressure. Another sensor may provide data concerning ambient humidity. Moreover, the environmental sensor may also sense temperature. The environment may be sensed both inside of the display case and outside of the display case. This data is communicated to the control unit which makes a determination as to the correct amount of air required for the specific environmental conditions.

In this way, the refrigeration system offers an inexpensive and efficient mechanism for accommodating the changing environmental conditions in a supermarket or other retail establishment. The refrigeration system has the opportunity to obtain a wide variety of environmental data and make intelligent decisions to control temperature within the display case. This system may be employed practically because it may incorporate existing sensors and computer controls.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
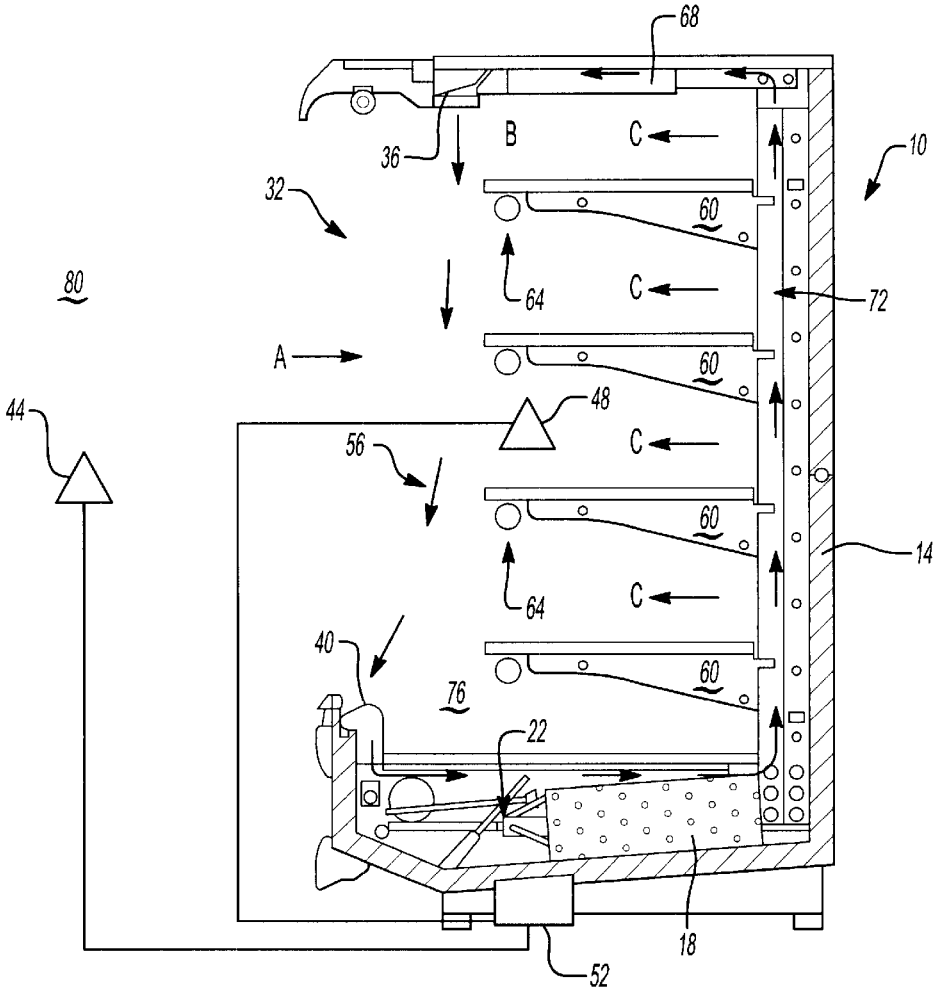
FIG. 1 illustrates a side profile of the embodiment of the invention, a refrigeration system.

FIG. 1 illustrates an embodiment of the invention, refrigeration system 10. Refrigeration system 10 comprises display case 14, evaporator coil 18, fan panel 22, control unit 52 and sensor 44. As known, display case 14 is cooled by evaporator coil 18. Fan panel 22 draws air from inlet 40 and blows the air across evaporator coil 18. Air travels up rear duct 72, which distributes some air along the direction of arrow C under shelves 60. Shelves 60 are lit by lights 64. Air not distributed in the direction of arrow C continues to travel up rear duct 72 to top duct 68. Top duct 68 has an outlet 36, which forces air in the direction of arrow B across open viewing area 32. Air from outlet 36 is then drawn to inlet 40, thereby forming air curtain 56 across open viewing area 32. Warm air in the direction of arrow A from exterior 80 of display case 14 is thereby limited from affecting the temperature of interior 76.

The novel aspect of this refrigeration system is the use of environmental sensors 44, 48 and control unit 52 to control the rate of air forming air curtain 56. Environmental sensors 44 and 48 may comprise such commonly available sensors as a temperature sensor, a pressure sensor, a humidity sensor, or other sensor known to affect refrigeration. Environmental sensor 44 and environmental sensor 48 are both in communication with control unit 52, which is programmed to alter the rate of air blowing from fan panel 22 based on the sensed environmental data so that the desired temperature level is maintained in interior 76 of display case 14. Sensor 44 may sense environmental data of exterior 80 of display case 14 while environmental sensor 48 may sense environmental data of interior 76 of display case 14. Environmental sensor 48 may also comprise a refrigeration pressure sensor sensing pressure within evaporator coils 18.

The temperature information is used to be directly proportional to the air rate flow. As an example, should the temperature either outside or inside the display case increase, then the air flow rate would also desirably increase. As the environmental humidity increases, then the air flow rate would desirably increase as sensed by an environmental pressure sender. Moreover, as the pressure sensor on the refrigerant circuit associated with the coil increases, then it can be determined that the cooling load also increases.

It may be desirable to decrease air flow rate to reduce the load on the refrigerant circuit. Alternatively, if the circuit is on a defrost cycle, it may be desirable to increase the air flow rate to assist in defrosting.

Figure 2:
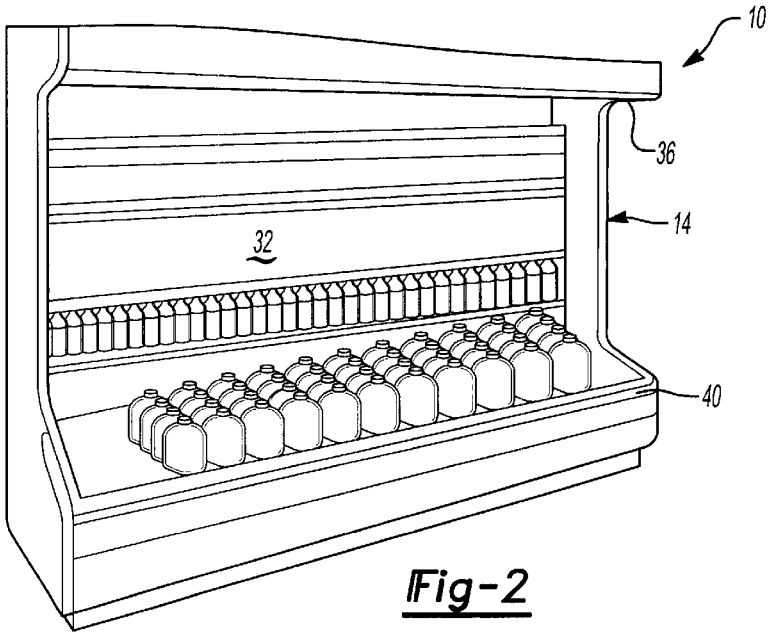
FIG. 2 illustrates a front view of the embodiment of FIG. 1, highlighting the open viewing area of the display case.

FIG. 2 shows a front view of refrigeration system 10. Display case 14 has outlet 36 blowing air across viewing area 32 to inlet 40. As shown, display case 14 has no doors, permitting easy access to products stored on the shelves of the case. However, the present invention may be employed on refrigeration systems having doors or other closures.

Figure 3:
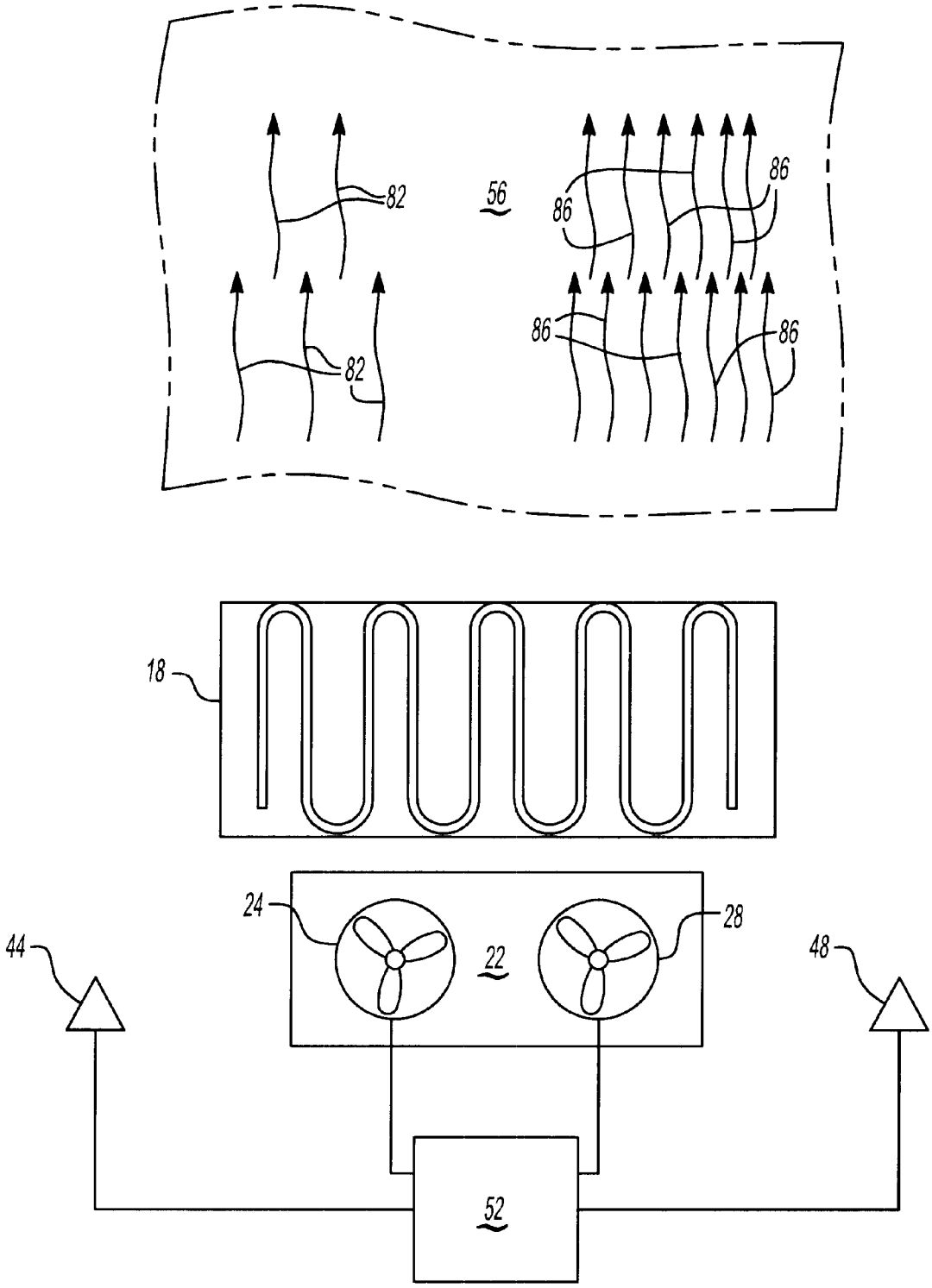
FIG. 3 illustrates a schematic view of the control system used to adjust the amount of air flow across the open viewing area.

FIG. 3 illustrates a schematic representation of the invention. Shown are control unit 52, environmental sensor 44, environmental sensor 48, fan panel 22 having first fan 24 and second fan 28, evaporator coil 18 and air curtain 56. Control unit 52 communicates with environmental sensor 44 and environmental sensor 48. Based on data from these sensors, control unit 52 is programmed to control separately and individually fan 24 and fan 28 of fan panel 22. This separate control of fans 24 and fan 28 allows air curtain 56 to comprise air front 82 and air front 86 that have different rates of air flow. Fan 24 moves air across evaporator coil 18 to form air front 82. Fan 24 controls the rate of air flow of air curtain 56 to create air front 82. Fan 28 moves air across coil 18 to form air front 86. Fan 28 controls air front 86 and its movement across open viewing area 32. Thus, air current 56 may comprise two different air fronts 82, 86 that move at different rates. In this way, not only may each air front be controlled based on environmental data but they may also be controlled separately to maximize and efficiently cool display case 14.

The rate of air blown across evaporator 18 by fan 24 and fan 28 may be adjusted by using commercially available fans. Control unit 52 may control the angle of fan blades with known adjustable fans. As known, by controlling the angle, volume and velocity of air driven by the fan may be altered. Known adjustable speed fans that may be controlled by control unit 52. Moreover, commercial fans exist that also allow the Hertz rating of each fan to be adjusted to thereby change the rate of air blown from the fan. An inverter having a variable hertz rating may be used to alter the speed of the fan motor, such as a synchronous motor, to thereby alter the air flow rate. By controlling the inverter, the air flow rate may be altered. One of ordinary skill in the art can envision other techniques to permit control unit 52 to control the amount of air blown by fans 24 and 28.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A refrigeration system comprising:

a display case having an exterior and an interior;

a coil cooling air in said display case;

at least one fan, driving air across said coil to said display case;

a viewing area in said display case, having an outlet on one side of said viewing area that blows air from said at least one fan to an inlet on the other side of said open viewing area that returns air to said at least one fan;

a duct for communicating air between said fan and said outlet;

at least one sensor for obtaining environmental data outside of said duct; and a control unit in communication with said at least one environmental sensor, for controlling said fan based on said environmental data.

2. The refrigeration system of claim 1 wherein said control unit alters the rate of air moved by said fan based on said environmental data.

3. The refrigeration system of claim 2 wherein said control unit alters the angle of a fan blade of said fan.

4. The refrigeration system of claim 2 wherein said control unit alters the hertz rating of said fan.

5. The refrigeration system of claim 2 wherein said control unit alters the speed of said fan.

6. The refrigeration system of claim 1 wherein at least one fan comprises at least a first fan and a second fan controlled separately by said control unit.

7. The refrigeration system of claim 6 wherein said control unit may control the rate of air moved by each of said fans differently.

8. The refrigeration system of claim 1 wherein said environmental sensor comprises a temperature sensor.

9. The refrigeration system of claim 1 wherein said environmental sensor comprises a pressure sensor.

10. The refrigeration system of claim 1 wherein said environmental sensor comprises a humidity sensor.

11. The refrigeration system of claim 1 wherein said environmental sensor senses environmental data from an exterior space outside of said display case.

12. The refrigeration system of claim 1 wherein said environmental sensor senses environmental data within an interior display space of said display case.

13. A method of controlling air flow rates in a refrigeration case comprising:

providing a display case with a first fan and a second fan for driving an air curtain to separate an interior of said display case from an exterior of said display case;

sensing an environmental conditions; and controlling the first fan separately from the second fan based upon said sensed environmental conditions.

14. The method of set forth in claim 13 wherein said sensed environmental condition is taken from a location exterior to said display case.

15. The method of claim 13 wherein the speed of said fan is increased or decreased based upon said sensed environmental data.

16. The method of claim 13 including the step of generating a first air flow from the first fan and generating a second air flow from the second fan, the first air flow greater than the second air flow.

17. The refrigeration system of claim 1 wherein said at least one sensor is located at least partially outside of said duct.

18. A refrigeration system comprising:

a display case having an exterior and an interior;

a coil cooling air in said display case;

a first fan and a second fan for driving air across said coil to said display case;

a viewing area in said display case, having an outlet on one side of said viewing area that blows air from said first fan and said second fan to an inlet across said viewing area that returns air to said first fan and said second fan;

at least one sensor for obtaining environmental data;

a control unit in communication with said at least one environmental sensor, for controlling said fan based on said environmental data; and wherein said first fan and said second fan are controlled separately by said control unit.

19. A refrigeration system comprising:

a display case;

a coil cooling air in said display case;

at least one fan driving air across said coil to said display case;

an open viewing area in said display case, having an outlet on one side of said viewing area that blows an air curtain to an inlet on the other side of said open viewing area that returns air to said at least one fan;

at least one sensor for obtaining environmental data; and a control unit in communication with said at least one environmental sensor, for controlling said at least one fan based on said environmental data wherein said air curtain separates an interior storage space for displaying product from an exterior space located outside of said display case, said at least one sensor located in at least one of spaces.

20. The refrigeration system of claim 19 wherein said at least one sensor is located in said interior storage space.

21. The refrigeration system of claim 19 wherein said at least one sensor is located in said exterior space.

* * * * *

UNITED STATES PATENT AND TRADEMARK OFFICE

CERTIFICATE OF CORRECTION

PATENT NO. : 6,619,052 B1
DATED : September 16, 2003
INVENTOR(S) : Robert V. Nash, Jr.

It is certified that error appears in the above-identified patent and that said Letters Patent is hereby corrected as shown below:

Column 4,
Line 37, "conditions" should be -- condition --

Column 6,
Line 7, "of spaces" should be -- of said spaces --

Signed and Sealed this

Fourth Day of November, 2003

JAMES E. ROGAN
*Director of the United States Patent and Trademark Office*